US008500666B2

(12) United States Patent
Clementes

(10) Patent No.: US 8,500,666 B2
(45) Date of Patent: Aug. 6, 2013

(54) MASSAGE DEVICE

(76) Inventor: Aileen Clementes, Concord, CA (US)

( * ) Notice: Subject to any disclaimer, the term of this patent is extended or adjusted under 35 U.S.C. 154(b) by 685 days.

(21) Appl. No.: 12/407,735

(22) Filed: Mar. 19, 2009

(65) Prior Publication Data

US 2009/0240176 A1 Sep. 24, 2009

Related U.S. Application Data

(60) Provisional application No. 61/070,059, filed on Mar. 20, 2008.

(51) Int. Cl.
*A61H 7/00* (2006.01)

(52) U.S. Cl.
USPC ..... 601/133; 601/135; 601/137; 606/204

(58) Field of Classification Search
USPC ..... 601/1, 84, 133–137, 23, 41, 112, 601/118–123; 606/201, 204, 237, 245, 203, 606/204.15; D24/211, 214, 215; 446/71, 446/496, 498; 434/275
See application file for complete search history.

(56) References Cited

U.S. PATENT DOCUMENTS

| | | | | | |
|---|---|---|---|---|---|
| 1,710,643 | A | * | 4/1929 | Hassler | 601/133 |
| 2,001,871 | A | * | 5/1935 | Foster | 601/136 |
| 2,690,746 | A | * | 10/1954 | Achberger | 601/133 |
| 2,959,167 | A | * | 11/1960 | Leclabart | 601/133 |
| 5,405,311 | A | * | 4/1995 | Pecora et al. | 601/135 |

* cited by examiner

*Primary Examiner* — Patricia Bianco
*Assistant Examiner* — Kari Petrik
(74) *Attorney, Agent, or Firm* — P. Jeff Martin; The Law Firm of P. Jeffrey Martin, LLC

(57) ABSTRACT

A therapeutic massage device, specifically a manual scalp massager that can both provide a soothing sensation to the user and also stimulate the sebaceous glands and hair follicles of a person's scalp, resulting in a healthier scalp and better looking hair. The device should efficiently, and without harm or discomfort to the user, be able to pinch the tightly drawn scalp of the user, thereby squeezing the sebaceous glands and improving oil production. The device should also be easy to use and should not require an inordinate amount of effort by the operator. In operation, the device can massage one's scalp by alternating between constricting and releasing the skin.

11 Claims, 6 Drawing Sheets

FIG. 6A
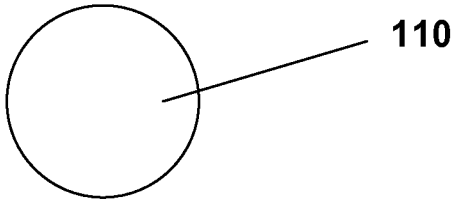
FIG. 6B
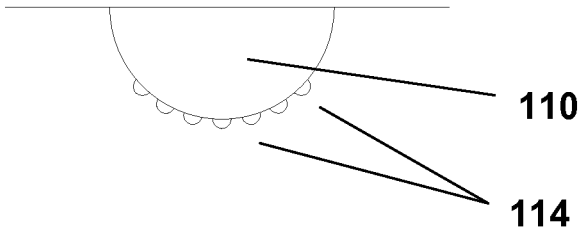
FIG. 6C
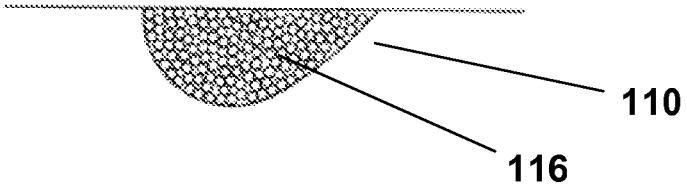
FIG. 6D
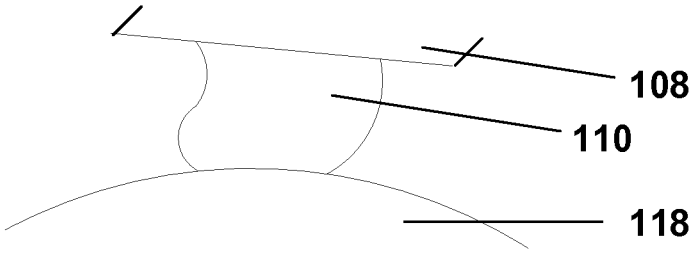
FIG. 6

MASSAGE DEVICE

CLAIM OF PRIORITY

The following application claims priority to U.S. Provisional Patent Application No. 61/070,059, filed Mar. 20, 2008, the complete contents of which are hereby incorporated by reference.

BACKGROUND

1. Field of the Invention

The present disclosure relates to the field of therapeutic massage devices, specifically a handheld device for massaging a person's head.

2. Background

The art of massage has been used to relieve stress and physical ailments for thousands of years. Although massage often focuses on the muscles and tendons of a person's back and neck, just about every part of the human body can benefit from some form of massage. In particular, regular physical stimulation of the head and scalp can provide not only psychological therapy, but also increased productivity of sebaceous glands and hair follicles, resulting in a healthier scalp and improved hair quality and appearance. However, it can be tiresome and difficult to massage one's own scalp, especially for people who have arthritis or other conditions that prevent prolonged use of the hands. Moreover, excess oils and dirt can be transferred from a person's hands to their own scalp or that of another person. In addition, since the skin on a person's head is tightly drawn, in contrast with most other parts of the body, it can be difficult to stimulate and squeeze the sebaceous glands with conventional massage methods and devices.

Currently, there are several products on the market intended to eliminate the need for direct hand-to-scalp contact when performing massage. However, these devices only glide over the scalp or apply light pressure at certain points, and are thus useful only when a calming effect is desired. For example, the Head Trip Therapeutic Massager from The Happy Company has multiple long metal prongs, the tips of which a user places on her head and lowers and raises to rub against the scalp. While this device may provide an enjoyable sensation for some, it can also be bothersome or inadequate for people looking for more of a rubbing and/or pinching massage. This type of device can also be difficult to use; since its handle is a great distance away from the prong tips, a user must reach high above her head in order to operate the device. Moreover, the prong tips have very little surface area, resulting in little contact with the scalp and inadequate stimulation of the sebaceous glands and/or hair follicles.

What is needed is a hand-held device that can be used on one's own scalp or that of another person, which can both provide mental relaxation and promote healthy oil production from the sebaceous glands of one's scalp through gentle squeezing of the skin. The device should be designed to gently tug at or pinch the tightly drawn skin on a person's head without causing pain or discomfort. The device should also be easy to use and clean, lightweight, and portable.

SUMMARY OF THE INVENTION

A hand-held massage device can comprise two frame elements. Each frame element can comprise a pivotal link member, a support member coupled with the distal end of the pivotal link member, and a set of a plurality of massage members coupled with the support member. Frame elements can be pivotally coupled, such that when the proximal ends of the pivotal link members have a first distance between them, the support members have a second distance between them; and when the proximal ends of the pivotal link members have a third distance between them that is greater than the first distance, the support members have a fourth distance between them that is less than the second distance. In some embodiments, a frame element can further comprise a handle member.

BRIEF DESCRIPTION OF THE DRAWINGS

FIG. 6 depicts several embodiments of a massage member of the present device.

DETAILED DESCRIPTION

Figure 1:
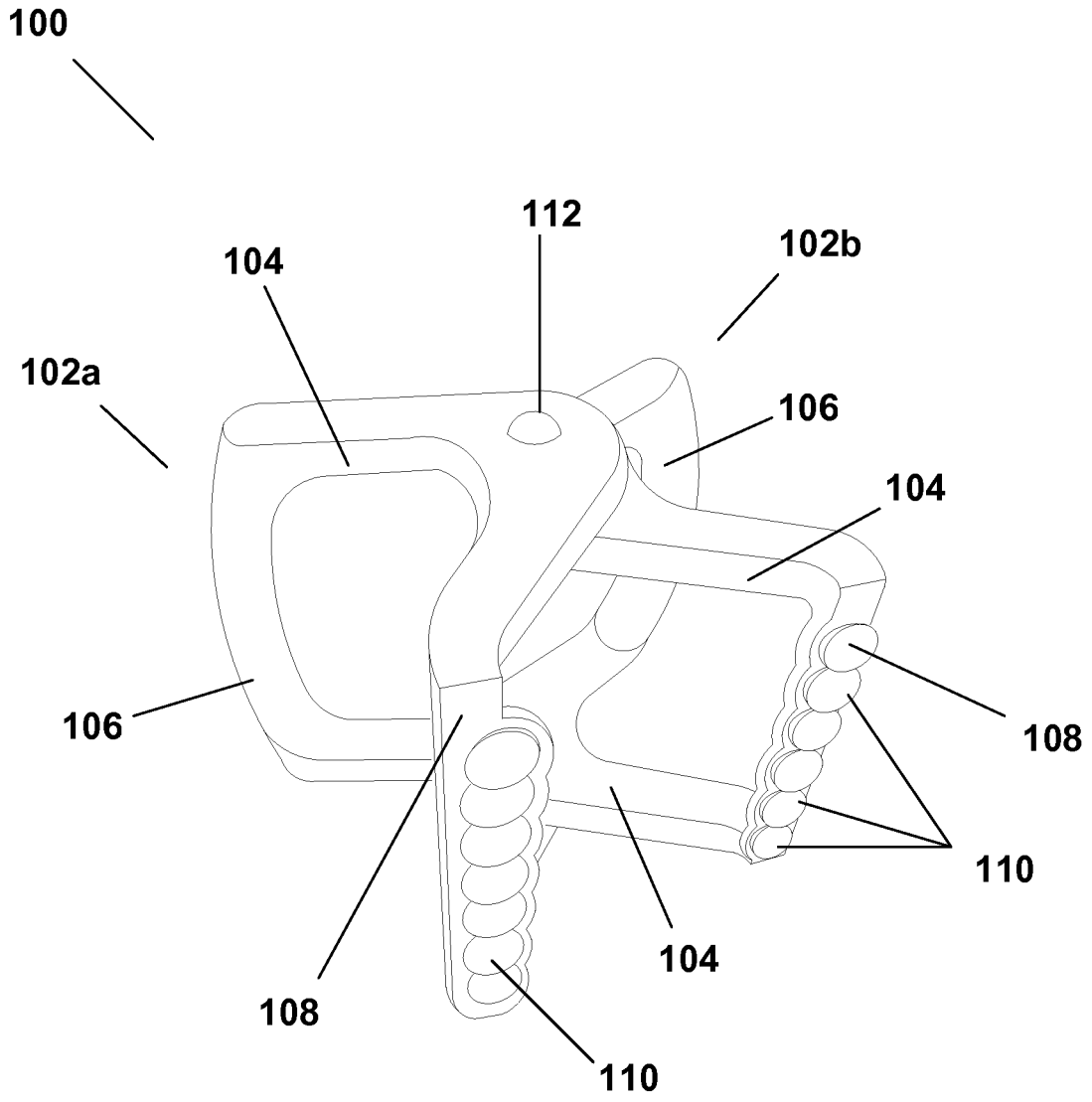
FIG. 1 depicts an isometric view of one embodiment of the present device.
Figure 2:
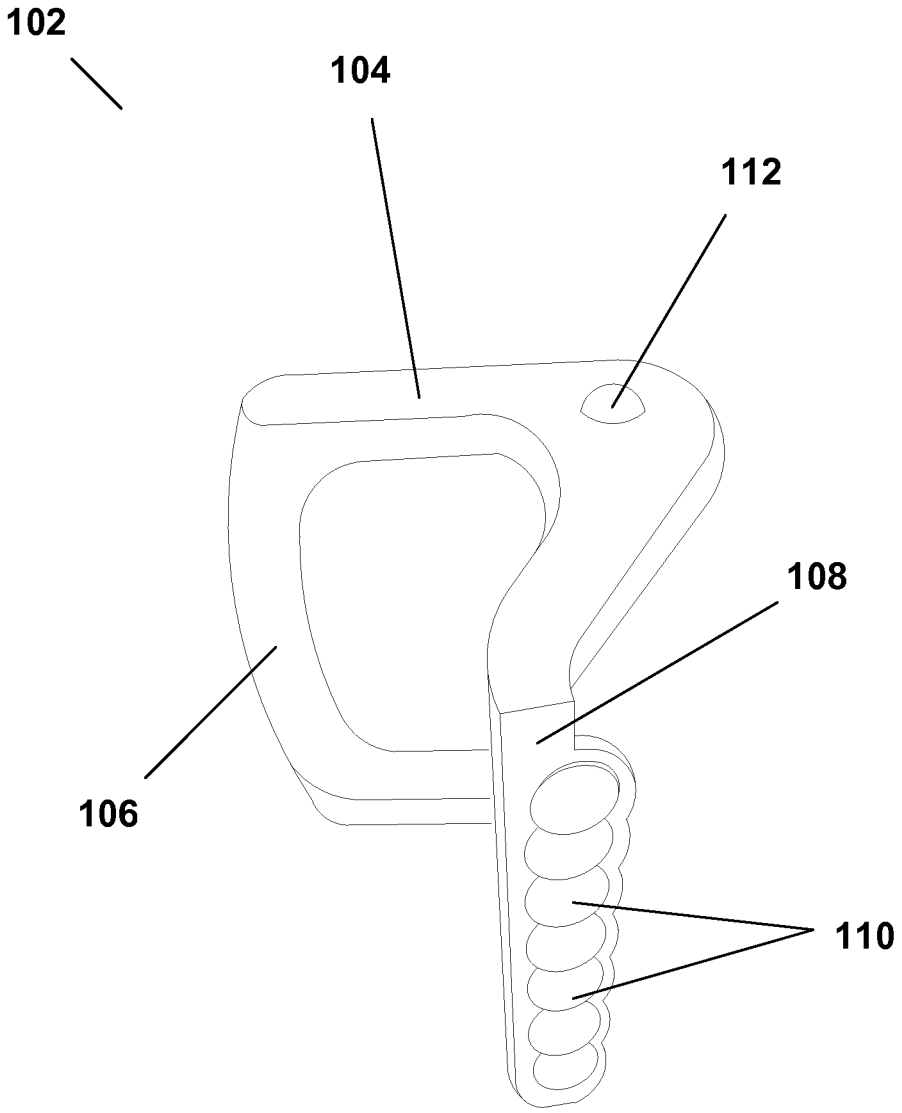
FIG. 2 depicts an isometric view of a frame element of the present device.

FIG. 1 illustrates an isometric view of the present device 100. A device 100 can comprise at least two frame elements 102*a* and 102*b* that can be pivotally coupled via a hinge mechanism 112. As shown in FIG. 2, a frame element 102 can comprise a pivotal link member 104 that can have a proximal end and a distal end. The distal end of a pivotal link member 104 can be coupled with a support member 108, which in turn can be coupled with a set of a plurality of massage members 110. In some embodiments and as shown in FIGS. 1 and 2, the proximal end of a pivotal link member 104 can also be coupled with a handle member 106.

A pivotal link member 104 can be made of plastic, wood, polymer, metal, or any other known and/or convenient material or combination of materials. The type of material used to form a pivotal link member 104 can be determined based on desired properties, such as preventing hair from damage when the device 100 is in use. A pivotal link member 104 can also have a smooth surface, bumps or protrusions, grooves or indentations, or any other known and/or convenient surface characteristic. By way of non-limiting example, a portion of a pivotal link member 104 can have a rough texture so as to increase the friction between the surface and a user's hand, thus preventing slippage. The surface of a pivotal link member 104 can also have a coating that can prevent slippage, provide anti-bacterial properties, condition a user's hair, or serve any other known and/or convenient purpose. A pivotal link member 104 can be any known and/or convenient color or combination of colors. As shown in FIG. 2, a pivotal link member 104 can have an A-shaped portion and can have both planar and curved surfaces. In alternate embodiments, a pivotal link member 104 can have any other known and/or convenient geometry. A pivotal link member 104 can be formed by injection molding or any other known and/or convenient method of manufacturing.

A support member 108 can provide support for and be coupled with a set of a plurality of massage members 110. A support member 108 can be made of plastic, wood, silicone, rubber, metal, ceramic, glass or any other known and/or convenient material. The material used to form a support member 108 can be rigid or semi-rigid. A support member 108 can be made of the same material as a pivotal link member 104 and/or a plurality of massage members 110, or can be comprised of a material different from other components of a device 100. The type of material used to form a support member 108 can be determined based on desired properties, such as preventing damage to hair while in use. The surface of a support member 108 can be smooth, rough, or have any other known and/or convenient surface characteristic. By way of non-limiting example, a support member 108 can be made of polystyrene and can have a smooth surface so as to allow hair to glide along the surface without catching and without being damaged. The surface of a support member 108 can also have anti-bacterial or conditioning properties, or any other known and/or convenient properties. A support member 108 can be any known and/or convenient color or combination of colors, and can be the same as or different than the color of other components of a device 100.

Figure 4:
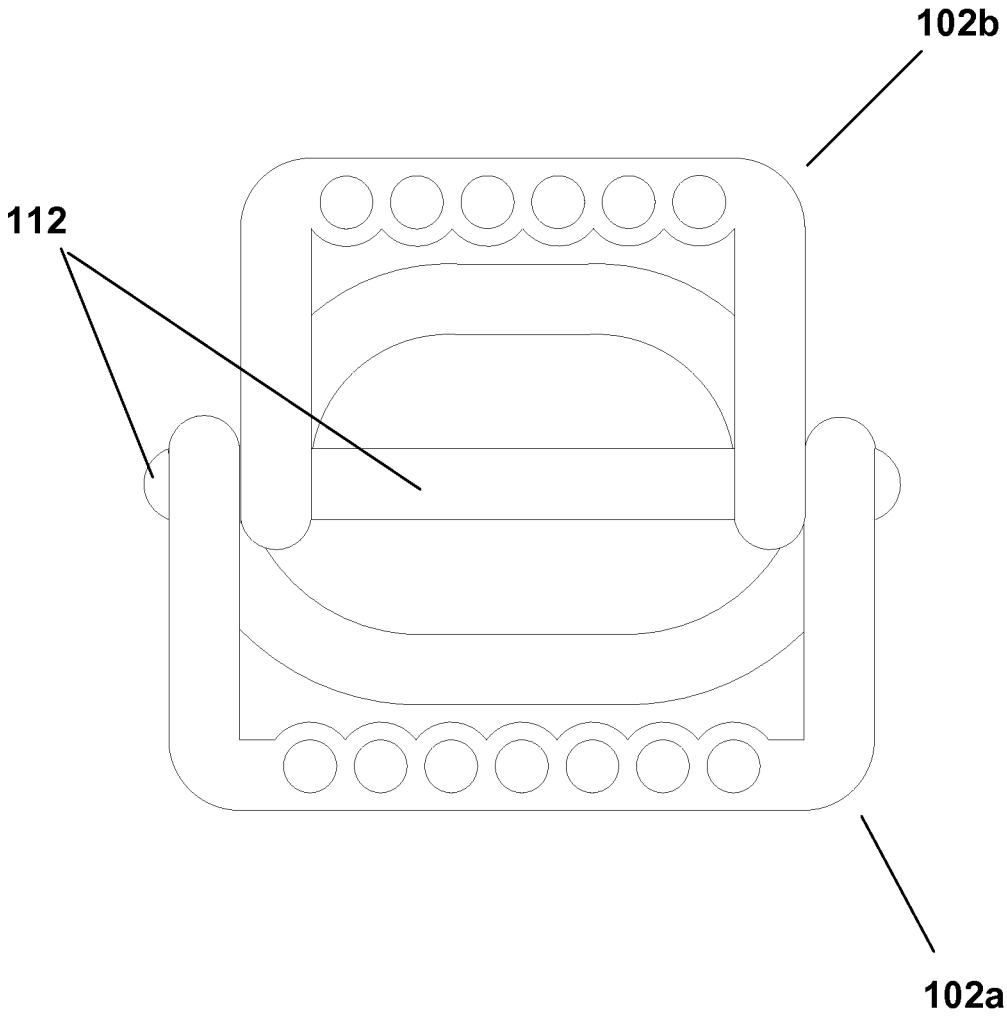
FIG. 4 depicts an underside view of one embodiment of the present device.
Figure 5:
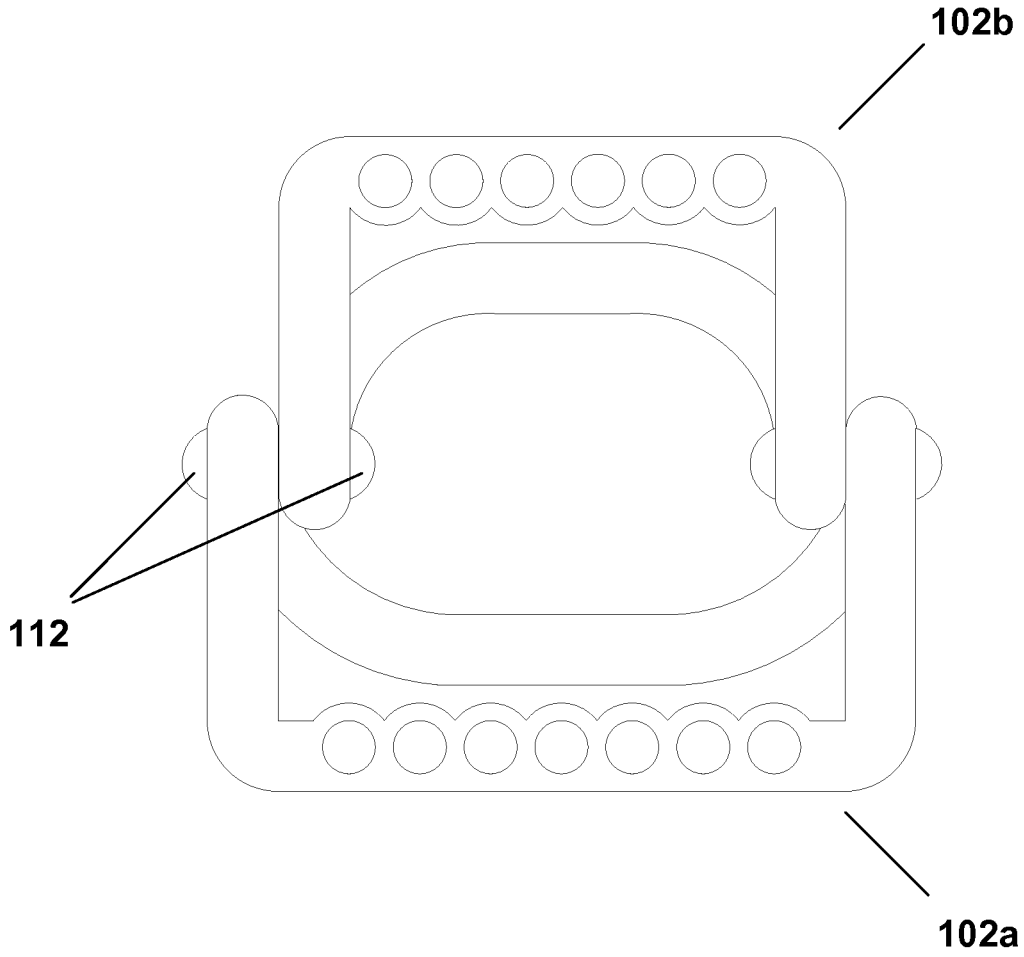
FIG. 5 depicts an underside view of another embodiment of the present device.

FIGS. 1 and 2 depict a plurality of massage members 110. A set of massage members 110 can be coupled with a support member 108 of a frame element 102. A plurality of massage members 110 can be coupled with a support member 108 via adhesive, ultrasonic bonding, pins, nails, or any other known and/or convenient method of bonding. As shown in FIG. 4, a first set of massage members 110 coupled with a first support member 108 of a frame element 102*a* can have a different number of massage members 110 than a second set of massage members 110 coupled with a support member 108 of a frame element 102*b*. In other embodiments, each set of massage members 110 on two or more frame elements 102 can have the same number of massage members 110. As depicted in FIGS. 4 and 5, a first set of massage members 110 of a frame element 102*a* can have seven (7) massage members 110, and a second set of massage members 110 of a frame element 102*b* can have six (6) massage members 110. Each set of massage members 110 can be positioned such that when their respective support members 108 are brought together, each massage member 110 on a first support member 108 can be staggered with respect to each massage member 110 on a second support member 108.

In some embodiments, a plurality of massage members 110 can comprise polymer, wood, metal, ceramic or any other known and/or convenient rigid material or combination of rigid materials that will not deform upon the application of pressure in normal use of a device 100. In alternate embodiments, a plurality of massage members 110 coupled with a support member 108 can comprise flexible or semi-flexible material so as to deform to a desired degree when pressed against a user's scalp 118, as depicted in FIG. 6D. A flexible or semi-flexible massage member 110 can be made entirely of one material, such as silicone. In other embodiments, a flexible material, such as but not limited to microfiber, velvet, nylon, silk, or natural fabric, can encapsulate another flexible material or combination of materials, such as but not limited to gel, small beads, or silicone. By way of non-limiting example, as shown in FIG. 6C, a massage member 110 can comprise a plurality of small rigid beads 116 partially bounded by Neoprene.

As illustrated in FIG. 6B, the surface of a massage member 110 can have small protrusions 114 that can provide a different type of sensation and/or sebaceous gland stimulation as compared with a smooth or rough surface. In other embodiments, the surface of a massage member 110 can have ridges or any other known and/or convenient surface characteristic. The coefficients of friction of the surfaces of massage members 110 are determined by the surface material, which in turn can affect how massage members 110 can glide against a person's scalp. By way of non-limiting example, a rough rubber surface on a massage member 110 can slightly tug at the scalp when a device 100 is in use, while a smooth plastic surface can easily slide over the scalp and hair.

A massage member 110 can also have anti-bacterial or conditioning properties, either embedded or as a coating, or can have any other known and/or convenient properties. Massage members 110 can be any known and/or convenient color or combination of colors, and at least one massage member 110 can be a different color than another massage member 110.

Figure 3:
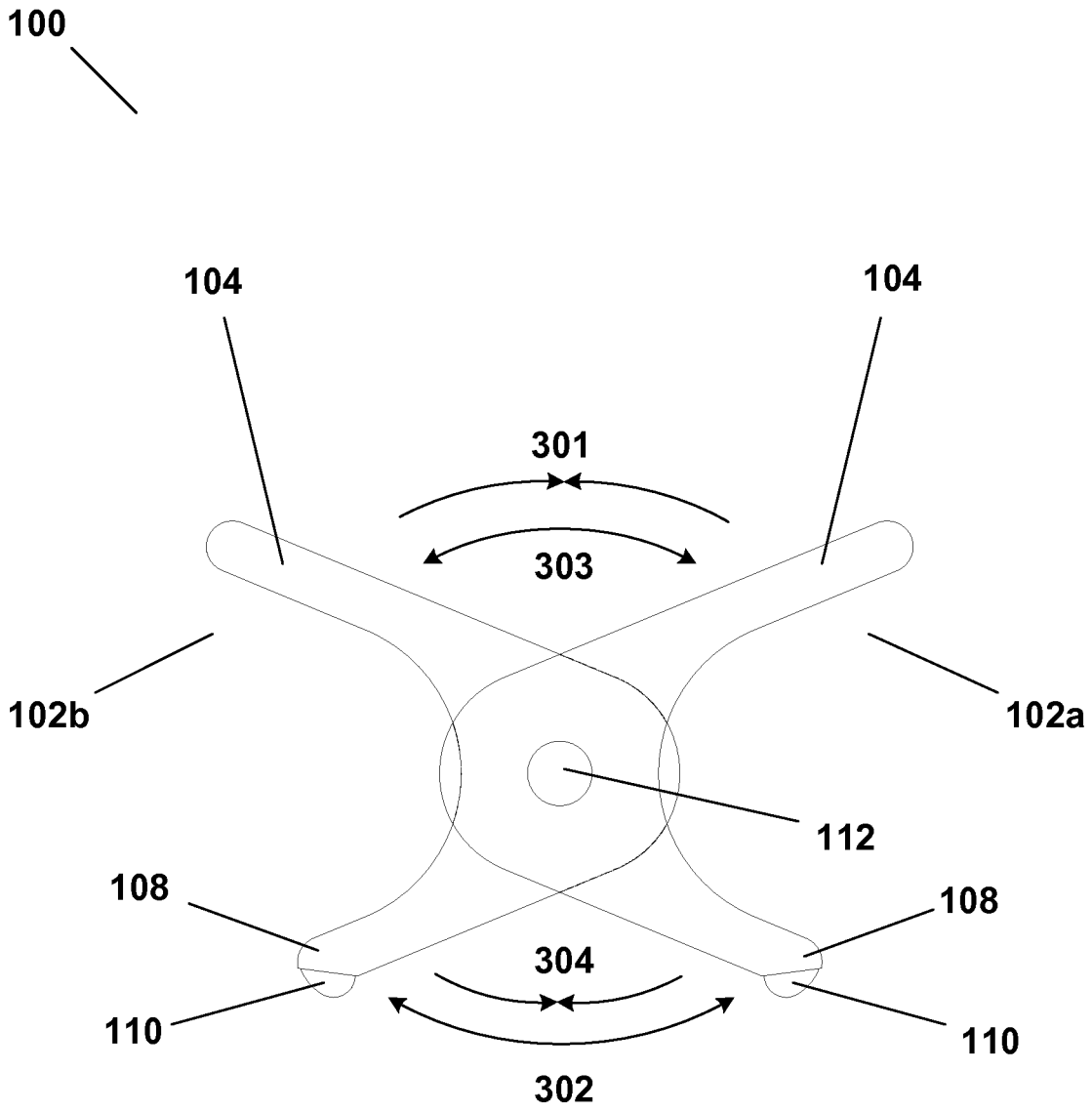
FIG. 3 depicts a side view of the embodiment depicted in FIG. 1.

A plurality of massage members 110 can be spherical, elliptical, or can have any known and/or convenient geometry. The geometry of massage members 110 can affect the massaging effect that is produced by use of a device 100. As shown in FIG. 3, massage members 110 can have a teardrop-like geometry such that in use a large portion of the surface area of a massage member 110 can be in constant contact with a user's scalp and/or hair. Moreover, a teardrop geometry, as shown in FIG. 3, can provide a tugging or pinching effect on the scalp, thereby imparting a different sensation and/or gland stimulating effect when compared with a massage member 110 having less surface area contact with a user's scalp. As shown in FIG. 6A, in one embodiment a cross-section of a massage member 110 can be circular. In other embodiments, a massage member 110 can have any other known and/or convenient cross-section. Although FIG. 1 depicts a plurality of massage members 110 having the same geometry, in other embodiments at least one massage member 110 can have a different geometry than another massage member 110.

As shown in FIGS. 1 and 2, a frame element 102 can further comprise a handle member 106 coupled with the proximal end of a pivotal link member 104. A handle member 106 can be made of wood, polymer, metal, or any other known and/or convenient rigid or semi-rigid material suitable for accommodating a user's grip. A pivotal link member 104 and a handle member 106 can be comprised on the same material or combination of materials. In other embodiments, the materials can be different. A handle member 106 can have a circular, square, or elliptical latitudinal cross-section, or can have any other known and/or convenient cross-section geometry. A handle member 106 can be formed from the same piece of material as a pivotal link member 104, as shown in FIGS. 1 and 2. In other embodiments, a handle member 106 can be manufactured as a separate element that is subsequently bonded with a pivotal link member 104 via adhesive, ultrasonic bonding, nails, screws, or any other known and/or convenient method of bonding. A handle member 106 can also have anti-bacterial properties and/or can be coated with a material that can prevent hand slippage when in use.

A pivotal link member 104, handle member 106, support member 108, and massage members 110 can be formed from a single piece of material. In other embodiments, the aforementioned elements can be formed as separate parts and subsequently permanently or temporarily bonded via adhesive, ultrasonic bonding, nails, screws, staples, pins, or any other known and/or convenient method of bonding. A frame element 102 or elements thereof can be made by injection molding or any other known and/or convenient method of manufacturing.

As depicted in FIGS. 1-5, frame elements 102*a* and 102*b* can be pivotally coupled at any convenient point on each pivotal link member 104 via a hinge mechanism 112. As shown in FIG. 1, the pivot points of frame elements 102*a* and 102*b* can be proximate to the vertex of an angled segment of each pivotal link member 104. In FIG. 4, a hinge mechanism 112 is a rod extending through each pivot point of framing elements 102*a* and 102*b*. In an alternate embodiment, and as shown in FIG. 5, a hinge mechanism 112 can comprise pins that extend only through the portions of the pivot points of framing elements 102*a* and 102*b* that are in direct contact with each other. In yet alternate embodiments, a hinge mechanism 112 can be any other known and/or convenient mechanism that can pivotally couple at least two framing elements 102.

Referring to FIG. 3, frame elements 102*a* and 102*b* can be pivotally coupled with each other such that when the proximal ends of pivotal link members 104 have a first distance 301 between them, support members 108 can have a second distance 302 between them; and when the proximal ends of pivotal link members 104 have a third distance 303 between them that is greater than a first distance 301, support members 108 can have a fourth distance 304 between them that is less than a second distance 302.

In use, the operator of a device 100 can be either the person whose scalp is to be massaged or another person. The operator of a device 100, as depicted in FIG. 1, can grip handle members 106 of framing elements 102*a* and 102*b*. Massage members 110 can then be placed in contact with the scalp of either the operator or another person. The proximal ends of pivotal link members 104 can begin with a close distance 301 between them, and support members 108 can begin with a distance 302 between them. The proximal ends of pivotal link members 104 can then be separated to a distance 303 between them by pivoting frame elements 102*a* and 102*b* via a hinge mechanism 112. This action can cause support members 108 to move closer together to a distance 304 between them, gently squeezing the scalp. An operator can then repeat the aforementioned actions at any desired speed and while applying a desired amount of pressure on a device 100. These actions can cause massage members 110 to move about a person's scalp, alternating between squeezing and releasing the skin, resulting in a calming sensation. Additionally, the teardrop geometry of massage members 110, as shown in FIG. 3, can allow a large surface area of massage members 110 to be in constant contact with a person's scalp, thereby facilitating a tugging or pinching effect.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A massage device, comprising:

a first frame element comprising a first pivotal link member, a second pivotal link member, a first support member coupled between the distal ends of said first pivotal link member and said second pivotal link member, and a first set of a plurality of massage members coupled with said first support member;

a second frame element comprising a third pivotal link member, a fourth pivotal link member, a second support member coupled between the distal ends of said third pivotal link member and said fourth pivotal link member, and a second set of a plurality of massage members coupled with said second support member;

wherein said first frame element and said second frame element are directly pivotally coupled along one pivot axis via at least one hinge mechanism at pivot points located substantially at the midpoints of said first, second, third, and fourth pivotal link members, such that when the proximal ends of said first and second pivotal link members are a first distance away from the proximal ends of said third and fourth pivotal link members, said first and second support members have a second distance between them; and when the proximal ends of said first and second pivotal link members are a third distance away from the proximal ends of said third and fourth pivotal link members that is greater than said first distance, said first and second support members have a fourth distance between them that is less than said second distance.

2. The massage device of claim 1, wherein said first frame element further comprises a first handle member, and said second frame element further comprises a second handle member.

3. The massage device of claim 1, wherein at least one of said first, second, third, and fourth pivotal link members is comprised of a material chosen from the group consisting of: wood, plastic, metal, polymer, ceramic and glass.

4. The massage device of claim 1, wherein at least one of said first, second, third, and fourth pivotal link members has a non-slip gripping portion.

5. The massage device of claim 1, wherein at least one of said first and second sets of a plurality of massage members is comprised of a material chosen from the group consisting of: plastic, wood, silicone, rubber, metal, ceramic and glass.

6. The massage device of claim 1, wherein said first set of a plurality of massage members comprises a different number of massage members than said second set of a plurality of massage members.

7. The massage device of claim 1, wherein at least one member of at least one of said first and second sets of a plurality of massage members is adapted to partially deform when pressed against a person's scalp.

8. The massage device of claim 1, wherein at least one member of at least one of said first and second sets of a plurality of massage members has an elliptical cross-section.

9. The massage device of claim 1, wherein said at least one hinge mechanism comprises a first pin that extends through the pivot points of said first and third pivotal link members, and a second pin that extends through the pivot points of said second and fourth pivotal link members.

10. The massage device of claim 1, wherein said first, second, third, and fourth pivotal link members each comprise two or more angled segments, and the pivot points of each pivotal link member are positioned proximate to the vertex of the angle formed by the angled segments of the pivotal link member.

11. The massage device of claim 2, wherein:

said first handle member is coupled between the proximal ends of said first pivotal link member and said second pivotal link member; and said second handle member is coupled between the proximal ends of said third pivotal link member and said fourth pivotal link member.

* * * * *